US005169331A

United States Patent [19]

Caldwell et al.

[11] Patent Number: 5,169,331

[45] Date of Patent: Dec. 8, 1992

[54] LAMPHOLDER LEAD WIRE CONNECTOR

[75] Inventors: Andrew B. Caldwell; Alan R. Hass, both of Albion, Ind.

[73] Assignee: Group Dekko International, LaOtto, Ind.

[21] Appl. No.: 694,063

[22] Filed: May 1, 1991

[51] Int. Cl.[5] ..... H01R 33/02

[52] U.S. Cl. ..... 439/239; 439/232

[58] Field of Search ..... 439/232, 239-243, 439/438, 441, 550, 612, 619

[56] References Cited

U.S. PATENT DOCUMENTS

| | | | |
|---|---|---|---|
| 2,449,736 | 9/1948 | Bogen | 439/232 |
| 3,568,132 | 3/1971 | Johnson | 439/239 |
| 4,950,173 | 8/1990 | Minemura et al. | 439/342 |

FOREIGN PATENT DOCUMENTS

| | | | |
|---|---|---|---|
| 0580015 | 7/1959 | Canada | 439/242 |
| 0481091 | 8/1975 | U.S.S.R. | 439/438 |

*Primary Examiner*—Larry I. Schwartz
*Assistant Examiner*—Hien D. Vu
*Attorney, Agent, or Firm*—Barnes & Thornburg

[57] ABSTRACT

A lampholder for receiving one end of a fluorescent lamp and the associated pair of electrical contact pins is disclosed. The lampholder has a base member with slots for receiving the fluorescent lamp pins and a contact or terminal carrying plunger is disposed within the base member so as to be unilaterally movable between an extended position and a retracted position. The base member includes a pair of lead wire accepting openings remote from the pin receiving slots and the electrical contacts each include a lead wire accepting aperture. The apertures are in alignment with the openings only when the plunger is in the extended position. The lead wires fit snugly in the openings so that any subsequent flexing of the a lead wire occurs away from the region of contact between the wire and its corresponding terminal. When a lead wire is passed through an opening and corresponding aperture and the plunger is moved from the extended to the retracted position, the wire is deformed and securely gripped. The electrical contacts move into a position to make electrical connection with the lamp pins when the plunger moves into the retracted position.

25 Claims, 2 Drawing Sheets

LAMPHOLDER LEAD WIRE CONNECTOR

SUMMARY OF THE INVENTION

The present invention relates generally to lampholders and to lead connectors for such lampholders, and more particularly to a quick connect arrangement for a fluorescent lamp base.

Fluorescent lamps of the elongated cylindrical type having a pair of connector pins extending from each end are typically mounted by and receive their electrical energization from a pair of spaced apart holders each having a pair of resilient electrical terminals therein and a slot arrangement or similar opening leading to those terminals through which the pins may be laterally passed and the lamp then rotated about its cylindrical axis through approximately ninety degrees to firmly engage the pins, one each, with a corresponding terminal. The lampholders are typically made of an insulating material and mounted on a metal support, reflector, or housing by rivets or other fasteners. Electrical connection to the lampholders is typically accomplished by having the terminals connected to leads before the insulating material is formed and then connecting those leads to the incoming wiring at conventional screw terminal plates, e.g., on a switch, or by conventional twist fasteners.

Pre-connecting terminals to leads prior to molding the lampholder, fastening the lampholder in place with rivets, and making electrical connection by twist fasteners or screws are all expensive and time consuming.

In recent years, duplex outlets and wall mounted light switches having poke-in connectors which function like a female fishhook with an opening into which an insulation free lead may be pushed and securely captured have found great success in reducing wiring time. Such connectors have not, however, replaced the terminal screws which are still found on outlets and switches having the poke-in feature.

For either the poke-in or conventional screw connection, the lead wire has its insulation stripped off for a short distance at the end which stripping action may score the wire making it more easily broken if flexed back and forth a few times. Moreover, such flexing is more likely to occur at this scored location than elsewhere due to weakening caused by the scoring and because of the structure of the poke-in and screw connections.

Finally, it is known in the threaded base lamp socket art to provide a flexible lip arrangement on the socket which may be flexed so as to pass through a wall and then resume its normal shape to hold the socket in position. Such sockets have found utility primarily in the field of interior refrigerator lighting. Illustrative of this type mounting arrangement is U.S. Pat. No. 3,783,435.

Among the several objects of the present invention may be noted the avoidance of the above noted problems, effecting electrical connection between a lead wire and an electrical terminal by clinching the insulation-free end of the lead wire between the terminal and an associated insulator; the provision of a lead wire capture scheme for a lampholder which provides a measure of strain relief adjacent to where a lampholder terminal engages the lead wire; the provision of a quick connect fluorescent lampholder structure; the provision of a two part fluorescent lampholder which parts are permanently joined at their time of manufacture; and the provision of a simplistic yet secure lead wire connecting scheme. These as well as other objects and advantageous features of the present invention will be in part apparent and in part pointed out hereinafter.

In general, a lampholder for receiving one end of a fluorescent lamp and the associated pair of electrical contact pins thereof includes a lampholder base member having slots or other opening for receiving the fluorescent lamp pins and there is a contact carrying plunger received within the base member which plunger is unilaterally movable between an extended position and a retracted position. The plunger supports a pair of electrical contacts which contacts move into a position to make electrical connection with the lamp pins when the plunger moves into the retracted position. This same motion captures lead wires to mechanically hold the lead wires and to form an electrical connection to the contacts. The base member includes a pair of lead wire accepting openings remote from the pin receiving slots and the electrical contacts each include a lead wire accepting aperture. The apertures are aligned with the openings only when the plunger is in the extended position. Once captured, the lead wires fit snugly in the openings so that any subsequent flexing of the lead wire occurs away from the region of contact between the wire and its corresponding electrical contact or terminal. When the plunger is moved from the extended to the retracted position a shearing force is applied to the lead wire in the region between the opening and the aperture which imparts two nearly right angle bends to the lead. The base member may also include a pair of flexible tabs adapted to be flexed so as to pass through an opening in a mounting plate while an enlarged base region near the tabs or ears which region will not pass through the mounting plate opening whereby the tabs may be flexed and lampholder passed partially through the opening, and thereafter, the tabs allowed to resume their normal shape for locking the lampholder in position in the mounting plate.

Also in general and in one form of the invention, a lampholder for receiving one end of a fluorescent lamp and the associated pair of electrical contact pins thereof has a base member with slots for receiving the fluorescent lamp pins, and a contact carrying plunger received within the base member which is unilaterally movable between an extended position and a retracted position. The base member includes at least one opening which communicates with the plunger and the plunger includes a corresponding wedge having a gentle slope terminating at an abrupt shoulder which shoulder comes into registry with the opening when the plunger is in its retracted position to lock the plunger in that retracted position. At least one of the base member opening and the plunger wedge cooperates with a further opening or wedge to interlock the plunger and base member in the extended position to prevent removal of the plunger from the base member while allowing movement therefrom to the retracted position. Thus, either an additional opening is engaged by the wedge, or an additional wedge engages the opening to hold the two parts together, but in the lead wire accepting position.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
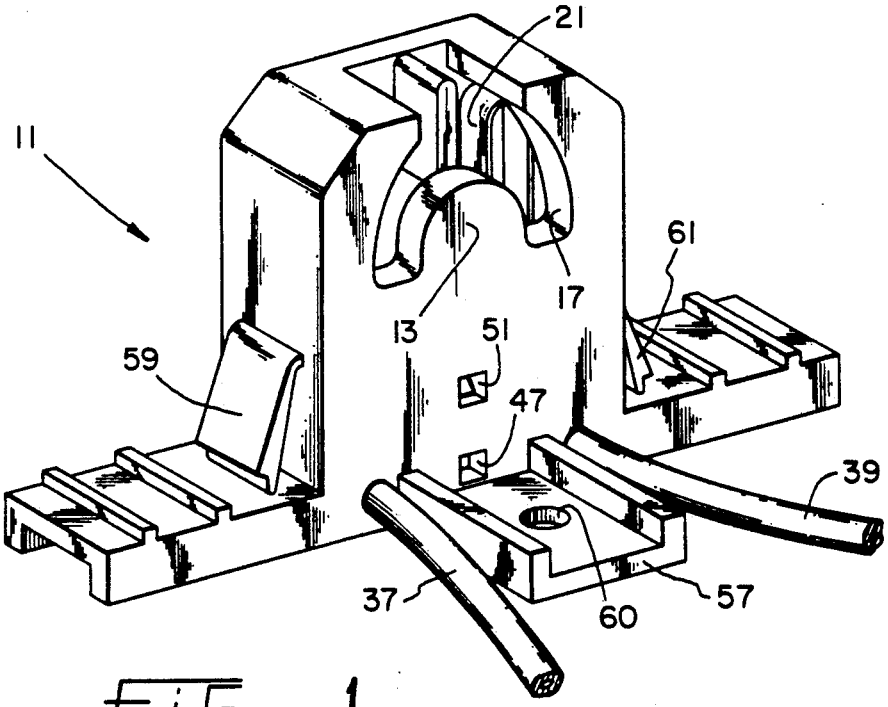
FIG. 1 is a perspective view of one fluorescent tube lampholder incorporating the present invention in one form thereof.

In FIG. 1, a single lampholder 11 is shown although it will be appreciated that for standard elongated cylindrical fluorescent lamps a pair of such lampholders spaced apart by the length of the lamp (less the length of its end terminals or pins) with the arcuately slotted surfaces 13 facing one another are typically employed.

Figure 2:
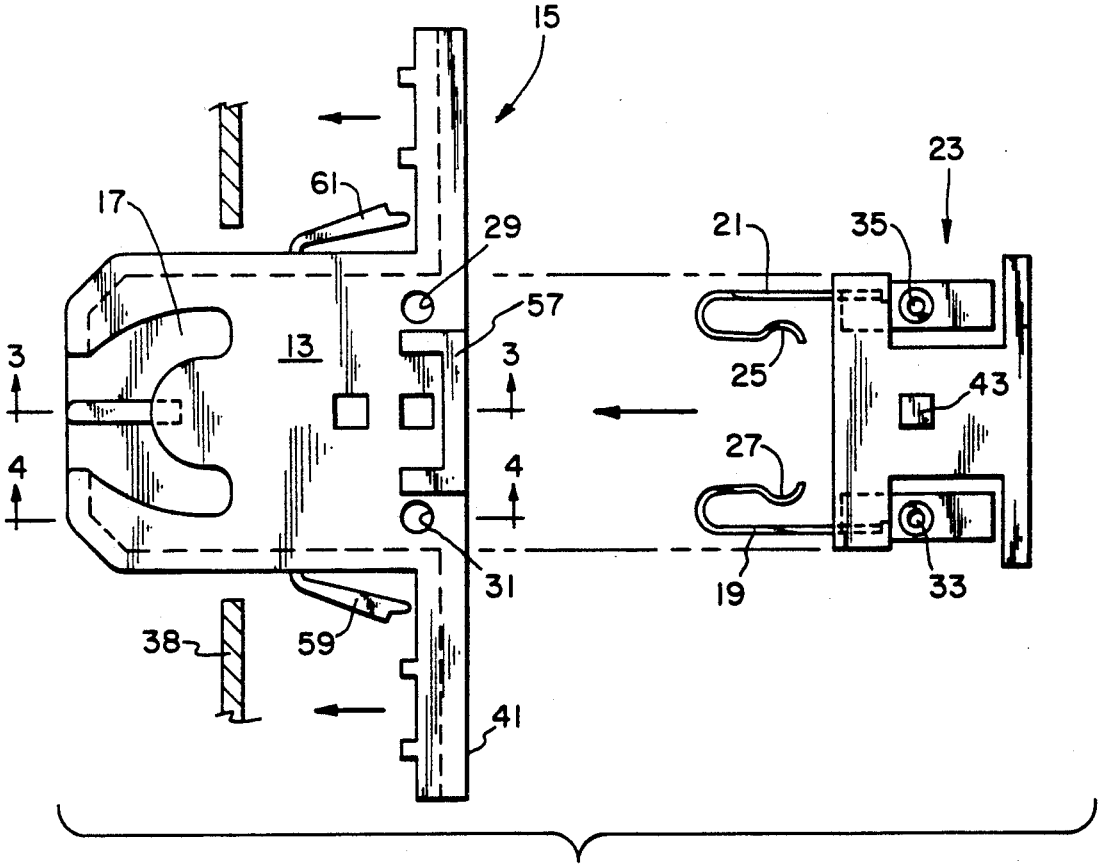
FIG. 2 is a front elevation view of the lampholder of FIG. 1 with the internal plunger thereof withdrawn.
Figure 3A:
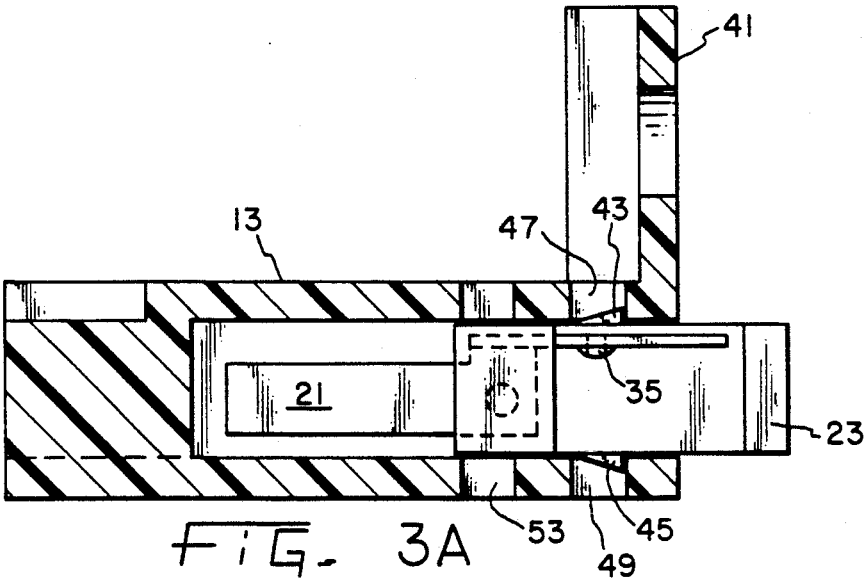
FIG. 3A is a view in cross-section along the lines 3—3 of FIG. 2 with the plunger in its extended position.
Figure 3B:
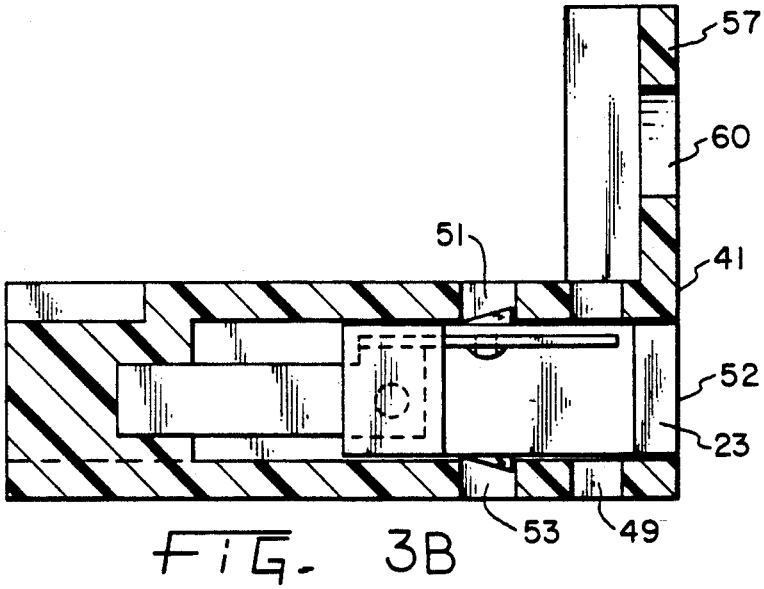
FIG. 3B is a view similar to FIG. 3A, but showing the plunger in its retracted position.
Figure 4A:
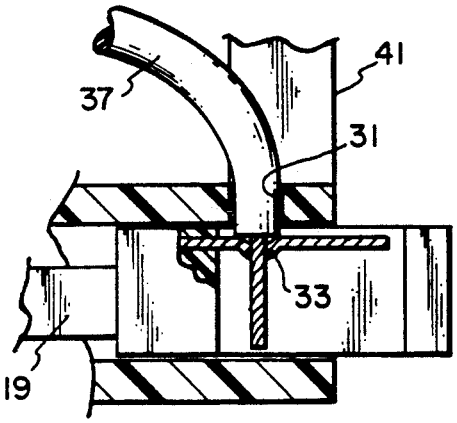
FIG. 4A is a view in cross-section along the lines 4—4 of FIG. 2 showing a lead wire being inserted.
Figure 4B:
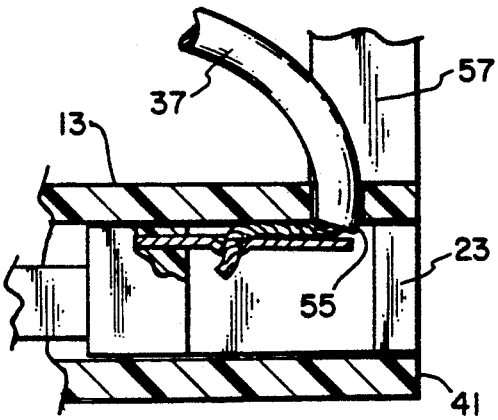
FIG. 4B is a view similar to FIG. 4A, but showing the lead wire of FIG. 4A captured by the plunger.

Generally speaking, FIG. 1 shows the lead wires 37 and 39 securely captured within the lampholder 11. The plunger 23 is not visible, but is in its retracted position as seen by the position of contact 21. In FIG. 2, the base member 15 and plunger 23 are shown separated from one another and from an illustrative wall or mounting panel 38 into which the lampholder is inserted. The lampholder is assembled and shipped from its point of manufacture in the configuration shown in FIGS. 3A and 4A, with the plunger 23 extending from the bottom surface 41. The plunger is held in this position by the engagement of wedge-shaped bosses 43 and 45 extending from the plunger 23 with a corresponding pair of holes 47 and 49 in the base 15. Thus, the base member 15 includes at least one opening, either 51 or 53, communicating with the plunger 23 and the plunger 23 includes a corresponding wedge, either 43 or 45 having a gentle slope terminating at an abrupt shoulder which shoulder comes into registry with the opening when the plunger is in its retracted position. As illustrated, the wedge 43 or 45 engages another hole 47 or 49 for interlocking the plunger and base member in the extended position to prevent removal of the plunger from the base member while allowing movement therefrom to the retracted position. An additional wedge cooperating with a common hole is a viable alternative. Note that the direction of inclination of the wedges 43 and 45 is such as to allow the plunger to be pushed further into the base 15, but not to be removed from the base. The insulation-free end of a lead wire such as 37 is inserted through the opening 31 in the base 15 and through the aligned aperture 33 in contact 19 and lead wire 39 is similarly placed through opening 29 and aperture 35. Plunger 23 is next forced further into the base 15 clinching the insulation-free end of the lead wire as shown in FIG. 4B. At this time the plunger assumes a location flush with the bottom 41 of the base and bosses 43 and 45 lock in the set of holes 51 and 53 as shown in FIG. 3B.

The lampholder 11 has a lampholder base member 15 for receiving the fluorescent lamp pins in the arcuate slots 17 and a contact (19 and 21) carrying plunger 23 received within the base member. The plunger is unilaterally movable between an extended position of FIGS. 3A and 4A, and a retracted position as shown in FIGS. 3B and 4B. The plunger 23 supports a pair of electrical contacts 19 and 21. Typically, the insulative portion of the plunger is injection molded about those contacts. The contacts move into a position to make electrical connection with the lamp pins when the plunger moves into the retracted position by presenting the detent arcs 25 and 27 symmetrically near the bottoms of the slots 17. The base member 15 includes a pair of lead wire accepting openings 29 and 31 and the electrical contacts 19 and 21 each include a lead wire accepting aperture 33 and 35 respectively. The apertures 33 and 35 are aligned with the openings 31 and 29 respectively only when the plunger is in the extended position as seen in FIG. 4A. FIGS. 4A and 4B clearly show how the lead wires such as 37 fit snugly in the corresponding openings such as 31 in the base 15 so that any subsequent flexing of the lead wire occurs away from the region of contact between the wire and its corresponding contact and FIG. 4B clearly illustrates the clinching to which a lead wire 37 is subjected when the plunger is moved from the extended to the retracted position. A shearing force is applied to the lead wire in the region between the opening and the aperture about where the insulation 55 terminates and this shearing force imparts two nearly right angle bends to the lead.

Returning to FIGS. 1 and 2, the lampholder base 15 has an optional mounting tab 57 with a screw or rivet accepting opening 60 for conventional mounting. The base member 15 further includes a pair of flexible tabs 59 and 61 adapted to be flexed so as to pass through an opening in a mounting plate 38, however, the enlarged base region near the tabs will not pass through the mounting plate opening. Thus, the tabs 59 and 61 may be flexed and the lampholder passed partially through the opening, and thereafter, the tabs allowed to resume their normal shape for locking the lampholder in position in the mounting plate.

In summary, the invention has a number of advantages over known prior fluorescent lampholders. The unit is easily and quickly mounted in a panel due to the presence of the tabs 59 and 61. The unit is easily and quickly electrically connected by inserting lead wire ends into the openings 29 and 31 and pressing the plunger 23 until its bottom surface 52 is flush with the bottom surface 41 of the base 15. The unit is relatively economical to manufacture.

From the foregoing, it is now apparent that a novel lead wire connecting arrangement suitable for fluorescent as well as other types of lampholders has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A lampholder for receiving one end of a lamp and the associated pair of electrical contact pins thereof comprising:

a lampholder base member formed to include a slot for receiving the contact pins; and a contact carrying plunger received within the base member and unilaterally movable between an extended position and a retracted position, said plunger supporting a pair of electrical contacts, the pair of contacts being disengaged from the contact pins when the plunger is in the extended position, the pair of contacts being configured to engage the contact pins to make electrical connection with the contact pins when the plunger moves into the retracted position.

2. The lampholder of claim 1 wherein the base member further includes a pair of flexible tabs adapted to be flexed so as to pass through an opening in a mounting plate, and an enlarged base region near the tabs which region will not pass through the mounting plate opening whereby the tabs may be flexed and lampholder passed partially through the opening, and thereafter, the tabs allowed to resume their normal shape for locking the lampholder in position in the mounting plate.

3. The lampholder of claim 1 wherein the base member includes a pair of lead wire accepting openings and the electrical contacts each include a lead wire accepting aperture, the apertures being aligned with the openings only when the plunger is in the extended position.

4. The lampholder of claim 3 wherein the lead wires fit snugly in the openings so that any subsequent flexing of the a lead wire occurs away from the region of contact between the wire and its corresponding contact.

5. The lampholder of claim 3 wherein a lead wire passing through an opening and corresponding aperture is deformed and securely gripped when the plunger is moved from the extended to the retracted position.

6. The lampholder of claim 5 wherein when the plunger is moved from the extended to the retracted position a shearing force is applied to the lead wire in the region between the opening and the aperture.

7. The lampholder of claim 6 wherein the shearing force imparts two nearly right angle bends to the lead.

8. The lampholder of claim 1 wherein the base member includes at least one opening communicating with the plunger, and the plunger includes a corresponding wedge having a gentle slope terminating at an abrupt shoulder which shoulder comes into registry with the opening when the plunger is in its retracted position.

9. The lampholder of claim 8 further comprising means including at least one of the base member opening and the plunger wedge for interlocking the plunger and base member in the extended position to prevent removal of the plunger from the base member while allowing movement therefrom to the retracted position.

10. A lampholder for receiving one end of a fluorescent lamp and the associated pair of electrical contact pins thereof comprising a lampholder base member receiving the fluorescent lamp pins, and a contact carrying plunger received within the base member and unilaterally movable between an extended position and a retracted position, the base member including a pair of lead wire accepting openings and the electrical contacts each including a lead wire accepting aperture, the apertures being aligned with the openings only when the plunger is in the extended position.

11. The lampholder of claim 10 wherein the lead wires fit snugly in the openings so that any subsequent flexing of the a lead wire occurs away from the region of contact between the wire and its corresponding contact.

12. The lampholder of claim 10 wherein the base member further includes a pair of flexible tabs adapted to be flexed so as to pass through an opening in a mounting plate, and an enlarged base region near the tabs which region will not pass through the mounting plate opening whereby the tabs may be flexed and lampholder passed partially through the opening, and thereafter, the tabs allowed to resume their normal shape for locking the lampholder in position in the mounting plate.

13. The lampholder of claim 10 further comprising a pair of electrical contacts coupled to the plunger, said pair of electrical contacts moving into a position to make an electrical connection with said electrical contact pins of the lamp upon movement of the plunger from its extended position to its retracted position.

14. The lampholder of claim 10 wherein a lead wire passing through an opening and corresponding aperture is deformed and securely gripped when the plunger is moved from the extended to the retracted position.

15. The lampholder of claim 14 wherein when the plunger is moved from the extended to the retracted position a shearing force is applied to the lead wire in the region between the opening and the aperture.

16. The lampholder of claim 15 wherein the shearing force imparts two nearly right angle bends to the lead.

17. The lampholder of claim 10 wherein the base member includes at least one opening communicating with the plunger, and the plunger includes a corresponding wedge having a gentle slope terminating at an abrupt shoulder which shoulder comes into registry with the opening when the plunger is in its retracted position.

18. The lampholder of claim 17 further comprising means including at least one of the base member opening and the plunger wedge for interlocking the plunger and base member in the extended position to prevent removal of the plunger from the base member while allowing movement therefrom to the retracted position.

19. A lampholder for receiving an end of a lamp including first and second electrical contact pins, the lampholder comprising:

a base member including a side wall and a bottom surface, the side wall being formed to include a slot therein for receiving the first and second contact pins and the bottom surface being formed to include an opening therein;

a plunger configured to be inserted into the opening in the bottom surface of the base member, the plunger being movable between an extended position and a retracted position;

a first contact coupled to a first portion of the plunger; and a second contact coupled to a second portion of the plunger, the first and second contacts being configured to engage the first and second contact pins, respectively, upon movement of the plunger from its extended position to its retracted position to electrically coupled the first and second contacts to the first and second contact pins.

20. The lampholder of claim 19 wherein the base member includes a pair of lead wire accepting openings and the electrical contacts each include a lead wire accepting aperture, the apertures being aligned with the openings only when the plunger is in the extended position.

21. The lampholder of claim 19 wherein the base member further includes a pair of flexible tabs adapted to be flexed so as to pass through an opening in a mounting plate, and an enlarged base region near the tabs which region will not pass through the mounting plate opening whereby the tabs may be flexed and lampholder passed partially through the opening, and thereafter, the tabs allowed to resume their normal shape for locking the lampholder in position in the mounting plate.

22. The lampholder of claim 19 wherein said slot formed in the side wall of the base member includes a first arcuate slot for receiving the first contact pin of the lamp and a second arcuate slot for receiving the second pin of the lamp.

23. The lampholder of claim 19 wherein the first contact includes a detent for holding the first contact in engagement with the first contact pin and the second contact includes a second detent for holding the second contact in engagement with the second contact pin.

24. The lampholder of claim 19 wherein the base member includes at least one opening communicating with the plunger, and the plunger includes a corresponding wedge having a sloped surface terminating at an abrupt shoulder which shoulder comes into registry with the opening when the plunger is in its retracted position.

25. The lampholder of claim 24 further comprising means including at least one of the base member opening and the plunger wedge for interlocking the plunger and base member in the extended position to prevent removal of the plunger from the base member while allowing movement therefrom to the retracted position.

* * * * *